US010444683B2

(12) United States Patent
Huang et al.

(10) Patent No.: US 10,444,683 B2
(45) Date of Patent: Oct. 15, 2019

(54) FUSING DEVICE ADAPTED FOR FUSING TONERS ONTO A PRINTING MEDIA AND PRINTING APPARATUS THEREWITH

(71) Applicant: AVISION INC., Hsinchu (TW)

(72) Inventors: Min-Tung Huang, Hsinchu (TW); Xiang-Chi Lee, Taoyuan (TW)

(73) Assignee: AVISION INC., Hsinchu (TW)

( * ) Notice: Subject to any disclaimer, the term of this patent is extended or adjusted under 35 U.S.C. 154(b) by 0 days.

(21) Appl. No.: 16/105,983

(22) Filed: Aug. 21, 2018

(65) Prior Publication Data

US 2019/0121270 A1 Apr. 25, 2019

(30) Foreign Application Priority Data

Oct. 25, 2017 (TW) ..... 106136666 A

(51) Int. Cl.
*G03G 15/20* (2006.01)

(52) U.S. Cl.
CPC . *G03G 15/2053* (2013.01); *G03G 2215/2067* (2013.01)

(58) Field of Classification Search
CPC ..... G03G 15/2042; G03G 15/2053; G03G 15/2064; G03G 2215/2025
USPC ..... 399/107, 110, 122, 320, 328–330
See application file for complete search history.

(56) References Cited

U.S. PATENT DOCUMENTS 6,559,421 B1 5/2003 Yura
9,063,485 B2 * 6/2015 Hazeyama ..... G03G 15/2017
2010/0322681 A1 12/2010 Kikuchi

FOREIGN PATENT DOCUMENTS

JP S62-178289 A 8/1987
TW 200834269 8/2008

* cited by examiner

*Primary Examiner* — Hoan H Tran
(74) *Attorney, Agent, or Firm* — Winston Hsu

(57) ABSTRACT

A fusing device includes a driving roller and a fusing unit. The driving roller is for driving a printing media to move. The fusing unit includes a heat insulating component, a heating component, a heat conductive component, a heat reflecting component and a fusing component. The heating component is for generating heat. The heat reflecting component includes a reflecting portion having a cross section formed in a conic section substantially. The reflecting portion is located at a side of the heating component away from the heat conductive component for reflecting the heat generated from the heating component to the heat conductive component. The heat conductive component transfers the heat to the fusing component. The fusing component contacts with the printing media to fuse toners onto the printing media when the driving roller drives the printing media to move.

24 Claims, 6 Drawing Sheets

FUSING DEVICE ADAPTED FOR FUSING TONERS ONTO A PRINTING MEDIA AND PRINTING APPARATUS THEREWITH

BACKGROUND OF THE DISCLOSURE

1. Field of the Disclosure

The present disclosure relates to a fusing device adapted for fusing toners onto a printing media and a printing apparatus therewith, and more particularly, to a fusing device capable of saving energy and time and a printing apparatus therewith.

2. Description of the Prior Art

A laser printer and a copying apparatus utilize a photoconductor drum to transfer toners onto a printing media. In order to fix the toners onto the printing media firmly, the laser printer and the copying apparatus usually further utilize a fusing device to fuse the toners onto the printing media by heating and pressing. However, the conventional fusing device usually utilizes a tungsten light bulb to provide heat for fusing the toners and further utilizes a metal plate to transfer the heat from the tungsten light bulb to a fusing strap, so as to fuse the toners onto the printing media by the fusing strap. However, the heat generated by the tungsten light bulb is transferred radially along with the light, and a part of the heat cannot be transferred to the metal plate. Therefore, it takes a long time to heat the metal plate to reach a predetermined temperature, which wastes time as well as energy.

SUMMARY OF THE DISCLOSURE

Therefore, it is an objective of the present disclosure to provide a fusing device capable of saving energy and time and a printing media therewith.

In order to achieve the aforementioned objective, the present disclosure discloses a fusing device for fusing toners onto a printing media. The fusing device includes a driving roller and a fusing unit. The driving roller is for driving the printing media to move along a moving direction. The fusing unit includes a heat insulating component, a heating component, a heat conductive component, a heat reflecting component and a fusing component. An accommodating space is formed inside the heat insulating component. An opening is formed on a side of the heat insulating component adjacent to the driving roller and communicated with the accommodating space. The heating component is located inside the accommodating space and for generating heat. The heat conductive component is connected to the heat insulating component and covers the opening. The heat reflecting component is located inside the accommodating space and separated from the heat conductive component. The heat reflecting component includes a reflecting portion. A cross section of the reflecting portion is formed in a conic section substantially. The reflecting portion is located on a side of the heating component away from the heat conductive component and for reflecting the heat generated by the heating component to the heat conductive component. The fusing component movably surrounds the heat conductive component and the heat insulating component. The heat conductive component transfers the heat to the fusing component. The fusing component contacts with the printing media to fuse the toners onto the printing media when the driving roller drives the printing media to move along the moving direction.

According to an embodiment of the present disclosure, the cross section of the reflecting portion is formed in a parabola section substantially.

According to an embodiment of the present disclosure, the heating component is located at a focal point of the reflecting portion.

According to an embodiment of the present disclosure, the cross section of the reflecting portion is formed in a branch of a hyperbola section substantially.

According to an embodiment of the present disclosure, the heating component is located at a focal point of the reflecting portion.

According to an embodiment of the present disclosure, a cross section of the heat insulating component is formed in a U shape substantially. The heat insulating component includes a first body and a second body connected to each other. The opening is formed on the second body. The heat reflecting component further includes two fixing portions respectively connected to two sides of the reflecting portion and clamped between the first body and the second body, and the heat conductive component is connected to a side of the second body away from the first body.

According to an embodiment of the present disclosure, the cross section of the reflecting portion is formed in a partial ellipse section substantially.

According to an embodiment of the present disclosure, the heating component is located at one of two focal points of the reflecting portion, and the heat conductive component is located at the other of the two focal points of the reflecting portion.

According to an embodiment of the present disclosure, a cross section of the heat insulating component is formed in a U shape substantially. A first step-shaped structure is formed on a side of the heat insulating component near the opening. The first step-shaped structure includes a first disposing platform and a second disposing platform, and a side of the heat conductive component and a side of the heat reflecting component are respectively connected to the first disposing platform and the second disposing platform and do not contact with each other.

According to an embodiment of the present disclosure, a second step-shaped structure is formed on another side of the heat insulating component near the opening. The second step-shaped structure includes a third disposing platform and a fourth disposing platform. Another side of the heat conductive component and another side of the heat reflecting component are respectively connected to the third disposing platform and the fourth disposing platform and do not contact with each other.

According to an embodiment of the present disclosure, the fusing device further includes a metal reinforcing component disposed on a side of the heat insulating component away from the driving roller and separated from the heat conductive component, and the metal reinforcing component reinforces structural strength of the heat insulating component.

According to an embodiment of the present disclosure, a cross section of the metal reinforcing component is formed in a U shape substantially, and two sides of the metal reinforcing component are fixed on the side of the heat insulating component away from the driving roller.

In order to achieve the aforementioned objective, the present disclosure further discloses a printing apparatus. The present disclosure includes a toner cartridge, a photoconductor drum and a fusing device. The toner cartridge is for storing toners. The photoconductor drum is for transferring the toners from the toner cartridge to a printing media. The fusing device is for fusing toners onto the printing media. The fusing device includes a driving roller and a fusing unit. The driving roller is for driving the printing media to move along a moving direction. The fusing unit includes a heat insulating component, a heating component, a heat conductive component, a heat reflecting component and a fusing component. An accommodating space is formed inside the heat insulating component. An opening is formed on a side of the heat insulating component adjacent to the driving roller and communicated with the accommodating space. The heating component is located inside the accommodating space and for generating heat. The heat conductive component is connected to the heat insulating component and covering the opening. The heat reflecting component is located inside the accommodating space and separated from the heat conductive component. The heat reflecting component includes a reflecting portion. A cross section of the reflecting portion is formed in a conic section substantially. The reflecting portion is located on a side of the heating component away from the heat conductive component and for reflecting the heat generated by the heating component to the heat conductive component. The fusing component movably surrounds the heat conductive component and the heat insulating component. The heat conductive component transfers the heat to the fusing component. The fusing component contacts with the printing media to fuse the toners onto the printing media when the driving roller drives the printing media to move along the moving direction.

In summary, the present disclosure utilizes the reflecting portion formed in the conic section substantially for reflecting the heat generated by the heating component, so that the heat generated by the heating component can be concentrated and reflected to the heat conductive component due to optical characteristic of the conic section. Furthermore, the heat conductive component of the present disclosure is separated from the heat reflecting component and the metal reinforcing component for preventing the heat from being transferred from the heat conductive component to the heat reflecting component or the metal reinforcing component. Therefore, the present disclosure can effectively reduce time of heating the heat conductive component to reach a predetermined temperature, which can save energy and time.

These and other objectives of the present disclosure will no doubt become obvious to those of ordinary skill in the art after reading the following detailed description of the preferred embodiment that is illustrated in the various figures and drawings.

DETAILED DESCRIPTION

In the following detailed description of the preferred embodiments, reference is made to the accompanying drawings which form a part hereof, and in which is shown by way of illustration specific embodiments in which the disclosure may be practiced. In this regard, directional terminology, such as "top," "bottom," "front," "back," etc., is used with reference to the orientation of the Figure(s) being described. The components of the present disclosure can be positioned in a number of different orientations. As such, the directional terminology is used for purposes of illustration and is in no way limiting. Accordingly, the drawings and descriptions will be regarded as illustrative in nature and not as restrictive.

Figure 1:
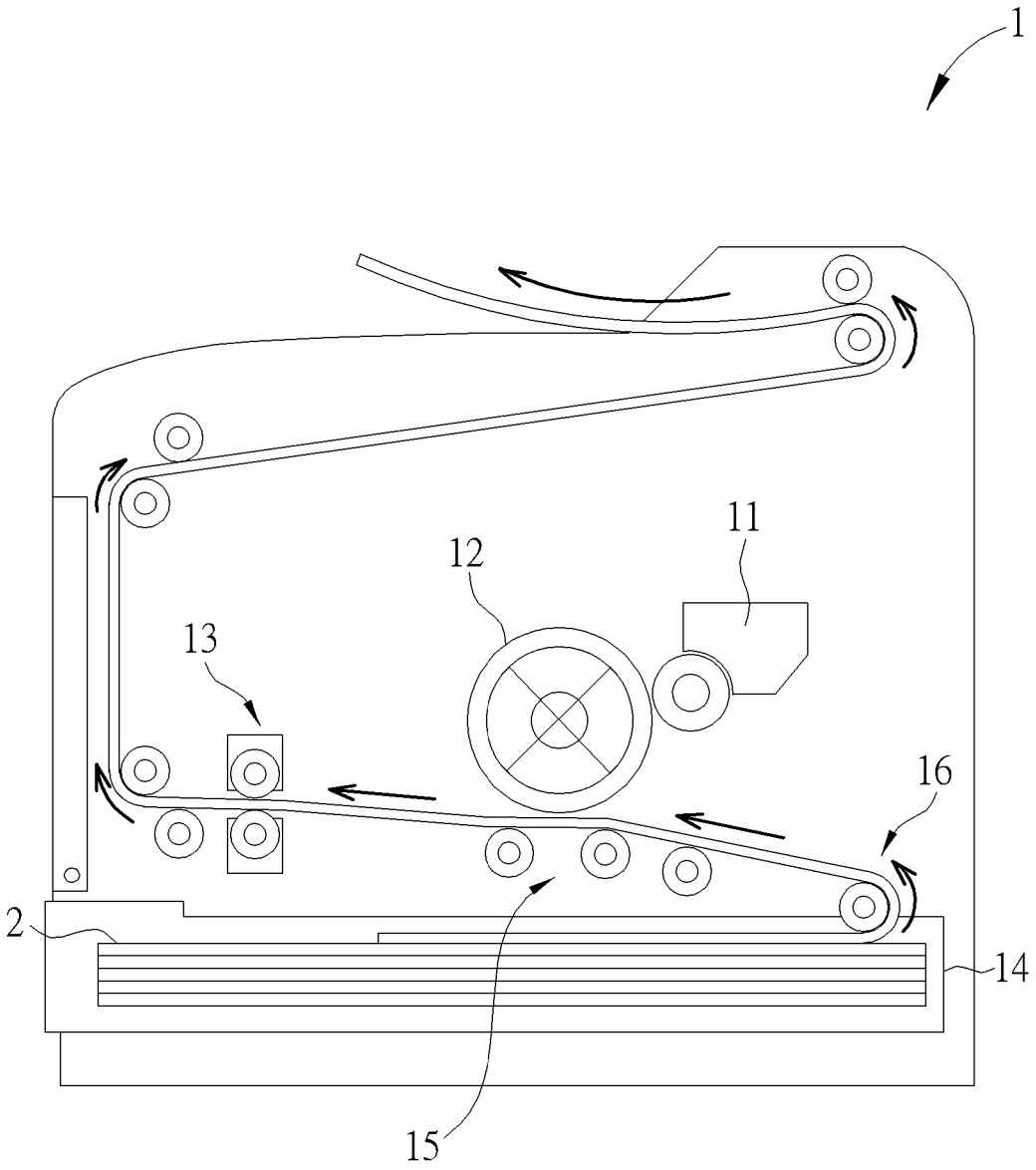
FIG. 1 is an internal structural diagram of a printing apparatus according to a first embodiment of the present disclosure.

Please refer to FIG. 1. FIG. 1 is an internal structural diagram of a printing apparatus 1 according to a first embodiment of the present disclosure. As shown in FIG. 1, in this embodiment, the printing apparatus 1 can be a printer or a copying apparatus. The printing apparatus 1 includes a toner cartridge 11, a photoconductor drum 12, a fusing device 13, a paper tray 14, a driving module 15 and a feeding passage 16. The toner cartridge 11 is for storing toners, which are not shown in the figure. The paper tray 14 is for storing a printing media 2, such as paper. The driving module 15 is for driving the printing media 2 to move from the paper tray 14 along the feeding passage 16 to pass through the photoconductor drum 12 and the fusing device 13. The photoconductor drum 12 is for transferring the toners from the toner cartridge 11 onto the printing media 2. The fusing device 13 is for fusing the toners onto the printing media 2.

Figure 2:
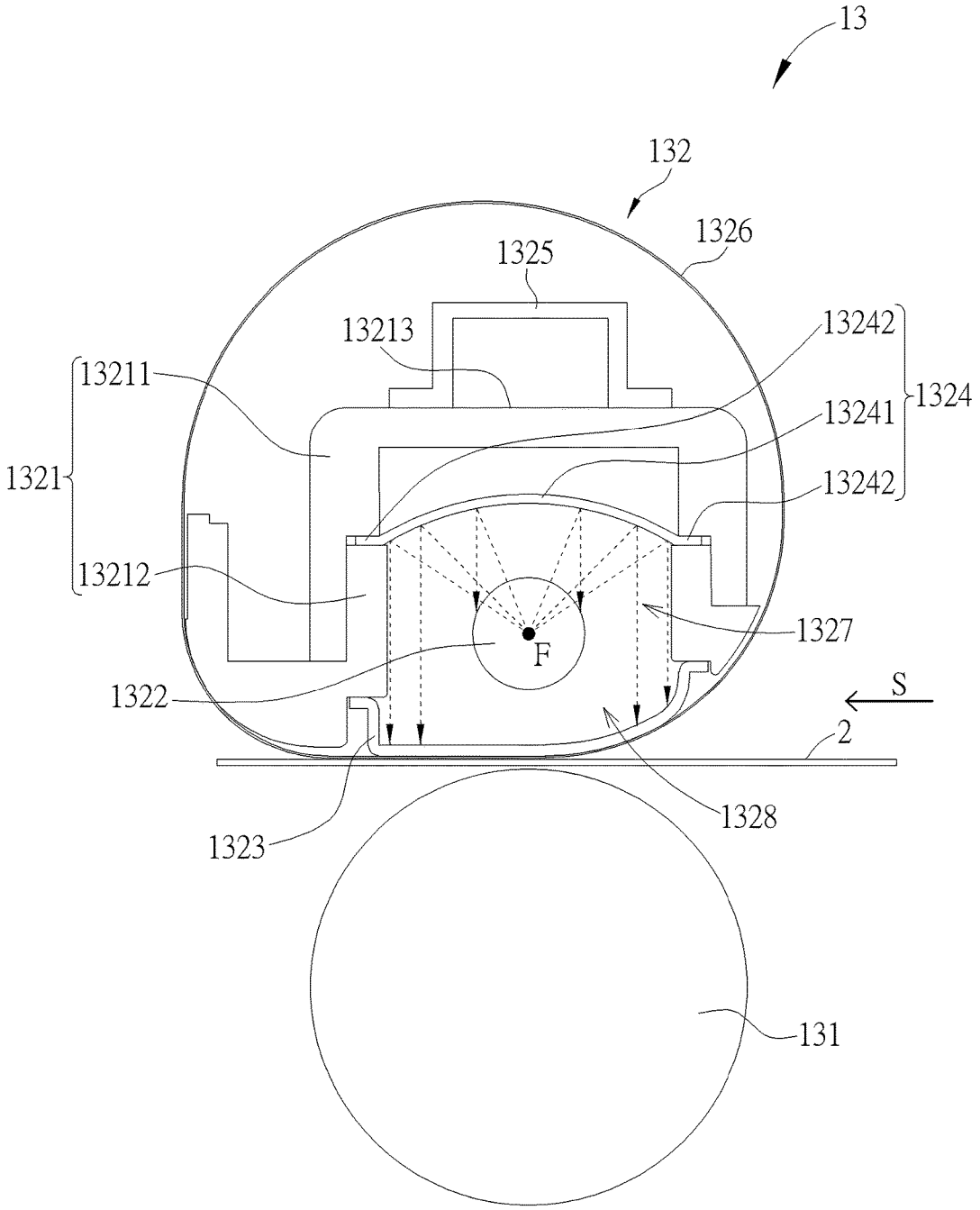
FIG. 2 is a diagram of a fusing device according to the first embodiment of the present disclosure.

Please refer to FIG. 2. FIG. 2 is a diagram of the fusing device 13 according to the first embodiment of the present disclosure. As shown in FIG. 2, the fusing device 13 includes a driving roller 131 and a fusing unit 132. The driving roller 131 is for driving the printing media 2 to move along a feeding direction S. The fusing unit 132 includes a heat insulating component 1321, a heating component 1322, a heat conductive component 1323, a heat reflecting component 1324, a metal reinforcing component 1325 and a fusing component 1326. An accommodating space 1327 is formed inside the heat insulating component 1321. An opening 1328 is formed on a side of the heat insulating component 1321 adjacent to the driving roller 131 and communicated with the accommodating space 1327. The heating component 1322 is located inside the accommodating space 1327 and for generating heat. The heat conductive component 1323 is connected to the heat insulating component 1321 and covers the opening 1328. The heat reflecting component 1324 is located inside the accommodating space 1327 and separated from the heat conductive component 1323. The heat reflecting component 1324 is for reflecting the heat generated by the heating component 1322 to the heat conductive component 1323. The metal reinforcing component 1325 is installed on an outer side of the heat insulating component 1321 and separated from the heat conductive component 1323.

The metal reinforcing component 1325 can be fixed onto the outer side of the heat insulating component 1321 and for reinforcing structural strength of the heat insulating component 1321, so as to prevent damage of the fusing unit 132 pressed by the driving roller 131. The fusing component 1326 movably surrounds the heat conductive component 1323 and the heat insulating component 1321. The fusing component 1326 can be a fusing strap or a fusing film. The heat insulating component 1321 and the metal reinforcing component 1325 are for supporting the fusing component 1326 cooperatively to maintain an outline of the fusing component 1326. The heat conductive component 1323 is for transferring the heat to the fusing component 1326. The fusing component 1326 is for contacting with the printing media 2 to fuse the toners onto the printing media 2 when the driving roller 131 drives the printing media 2 to move along the feeding direction S.

Specifically, in this embodiment, a cross section of the heat insulating component 1321 can be formed in a U shape substantially. The heat insulating component 1321 includes a first body 13211 and a second body 13212 connected to the first body 13211. The metal reinforcing component 1325 is fixed on a side of the first body 13211 away from the second body 13212. The opening 1328 is formed on the second body 13212. The heat conductive component 1323 is connected to the second body 13212 and covers the opening 1328. The heat reflecting component 1324 includes a reflecting portion 13241 and two fixing portions 13242. The reflecting portion 13241 is located at a side of the heating component 1322 away from the heat conductive component 1323 and for reflecting the heat generated by the heating component 1322 to the heat conductive component 1323. The two fixing portions 13242 are connected to two sides of the reflecting portion 13241 and clamped between the first body 13211 and the second body 13212. The heat conductive component 1323 is connected to a side of the second body 13212 away from the first body 13211 and separated from the heat reflecting component 1324, which prevents the heat from being transferred from the heat conductive component 1323 to the heat reflecting component 1324 to reduce heat loss and prevents damage of the heat reflecting component 1324 when the driving roller 131 presses the fusing unit 132.

Furthermore, a cross section of the reflecting portion 13241 can be formed in a conic section substantially. In this embodiment, the cross section of the reflecting portion 13241 can be formed in a parabola section substantially, and the heating component 1322 can be located at a focal point F of the parabola-shaped reflecting portion 13241. The heat generated by the heating component 1322 can be reflected toward the heat conductive component 1323 by the reflecting portion 13241 in straight and parallel paths after the heat is transferred to the reflecting portion 13241, so that the heat can be concentrated onto the heat conductive component 1323 effectively to reduce heating time of heating the heat conductive component 1323 to reach a predetermined temperature. In this embodiment, the heat reflecting component 1324 can preferably be bent from a mirror aluminum plate, and the heat insulating component 1321 can preferably be made of heat resistant plastic. However, it is not limited thereto. It depends on practical demands.

Furthermore, in this embodiment, in order to reinforce the structural strength of the heat insulating component 1321, a cross section of the metal reinforcing component 1325 can be formed in a U shape substantially. Two sides of the metal reinforcing component 1325 are fixed on a side 13213 of the heat insulating component 1321 away from the driving roller 131. In other words, the metal reinforcing component 1325 and the heat conductive component 1323 are located at two opposite sides of the heat insulating component 1321 and separated from each other. Therefore, it prevents the heat from being transferred to the metal reinforcing component 1325 by the heat conductive component 1323, so as to reduce the heat loss.

It should be noticed that, in the present disclosure, in order to reduce the heating time of heating the heat conductive component 1323 to reach the predetermined temperature, the cross section of the reflecting portion 13241 of the present disclosure is not limited to this embodiment and can be formed in any of the conic section. For example, in another embodiment, the cross section of the reflecting portion 13241 can be formed in a partial ellipse section or a branch of a hyperbola section substantially, so that the heat generated by the heating component 1322 can be reflected and concentrated onto the heat conductive component 1323. Detailed description of the reflecting portion 13241 having different cross sections is described as follows.

Figure 3:
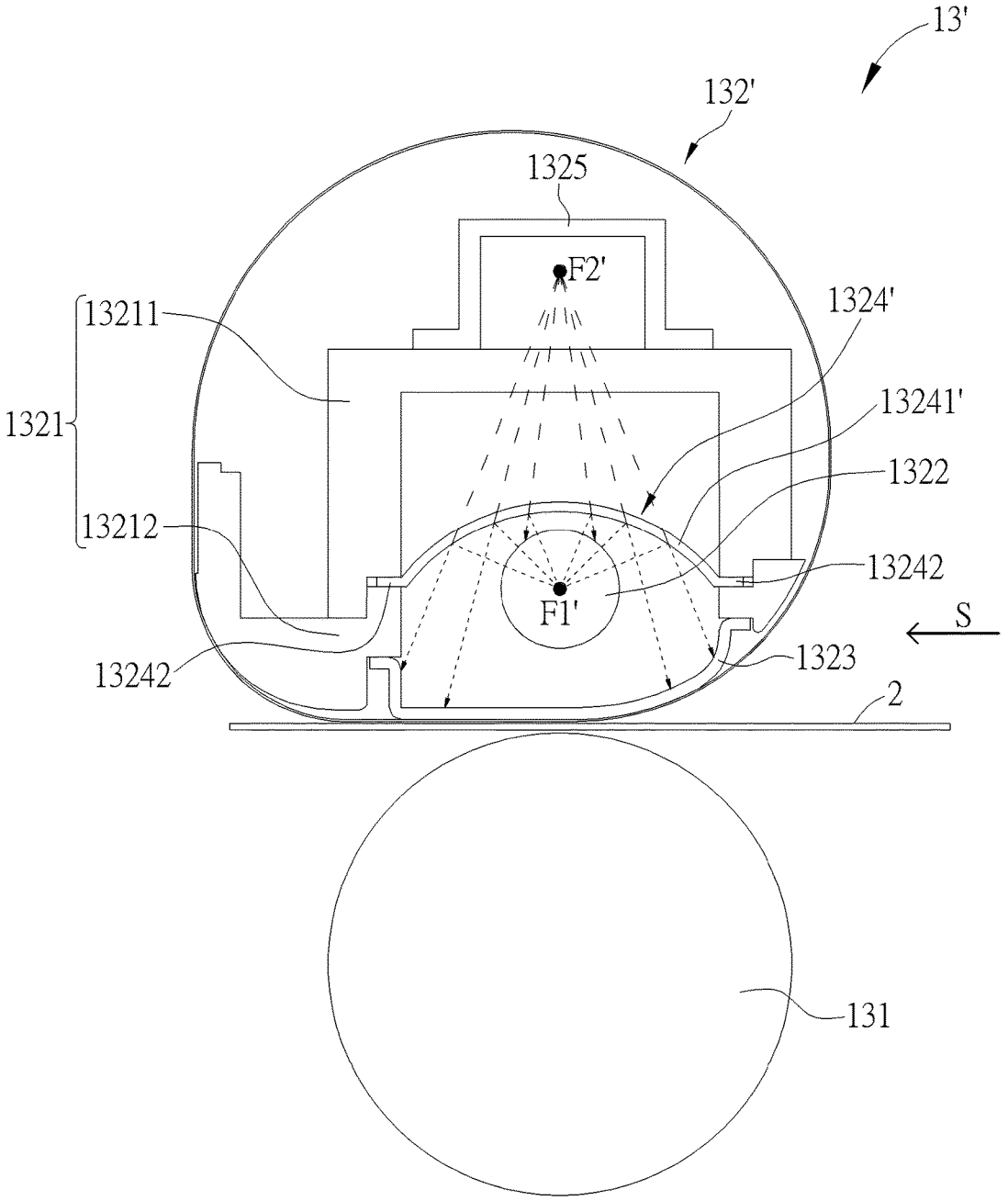
FIG. 3 is a diagram of a fusing device according to a second embodiment of the present disclosure.

Please refer to FIG. 3. FIG. 3 is a diagram of a fusing device 13' according to a second embodiment of the present disclosure. As shown in FIG. 3, different from the fusing device 13 of the first embodiment, a cross section of a reflecting portion 13241' of a heat reflecting component 1324' of a fusing unit 132' of the fusing device 13' can be formed in a branch of a hyperbola section substantially. The heating component 1322 can be located at a focal point F1' of the reflecting portion 13241'. The heat generated by the heating component 1322 can be reflected to the heat conductive component 1323 by the reflecting portion 13241'. Extending paths of the heat reflected by the reflecting portion 13241' can pass through a focal point F2' of another branch of the hyperbola section to reduce the heating time of heating the heat conductive component 1323 to reach the predetermined temperature. For simplicity, elements that have the same structures and functions as those illustrated in the aforementioned embodiment are provided with the same item numbers in this embodiment.

Figure 4:
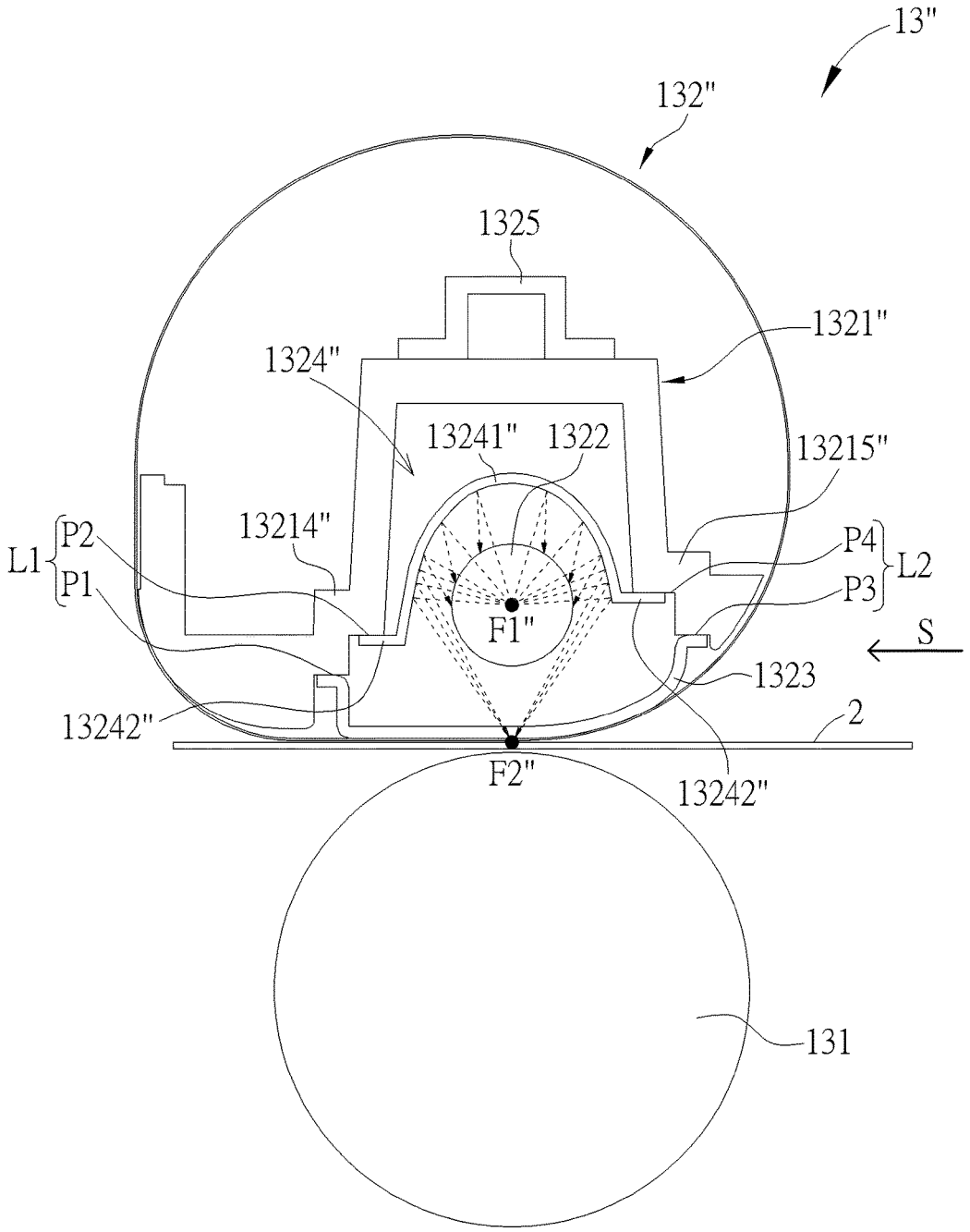
FIG. 4 is a diagram of a fusing device according to a third embodiment of the present disclosure.

Please further refer to FIG. 4. FIG. 4 is a diagram of a fusing device 13" according to a third embodiment of the present disclosure. As shown in FIG. 4, different from the fusing devices 13, 13' of the aforementioned embodiments, a cross section of a reflecting portion 13241" of a heat reflecting component 1324" of a fusing unit 132" of the fusing device 13" can be formed in a partial ellipse section substantially. The heating component 1322 is located at a focal point F1" of the reflecting portion 13241". The heat conductive component 1323 is located at the other focal point F2" of the reflecting portion 13241". The heat generated by the heating component 1322 can be reflected by the reflecting portion 13241" to the heat conductive component 1323 along directions of passing through the focal point F2" of the partial ellipse section, so that the heat can be concentrated onto the heat conductive component 1323 to reduce the heating time of heating the heat conductive component 1323 to reach the predetermined temperature. Furthermore, in this embodiment, a first step-shaped structure L1 is formed on a side 13214" of a heat insulating component 1321" of the fusing unit 132" adjacent to the opening 1328. The first step-shaped structure L1 includes a first disposing platform P1 and a second disposing platform P2. A second step-shaped structure L2 is formed on another side 13215" of the heat insulating component 1321" adjacent to the opening 1328. The second step-shaped structure L2 includes a third disposing platform P3 and a fourth disposing platform P4. Two sides of the heat conductive component 1323 are connected to the first disposing platform P1 and the third disposing platform P3 respectively. Two fixing portions 13242" of the heat reflecting component 1324" are connected to the second disposing platform P2 and the fourth disposing platform P4 respectively. In other words, the heat conductive component 1323 and the heat reflecting component 1324" can be disposed separately by the first step-shaped structure L1 and the second step-shaped structure L2. Therefore, it prevents the heat from being transferred from the heat conductive component 1323 to the heat reflecting component 1324" to reduce the heat loss and prevents damage of the heat reflecting component 1324" when the driving roller 131 presses the fusing unit 132.

Figure 5:
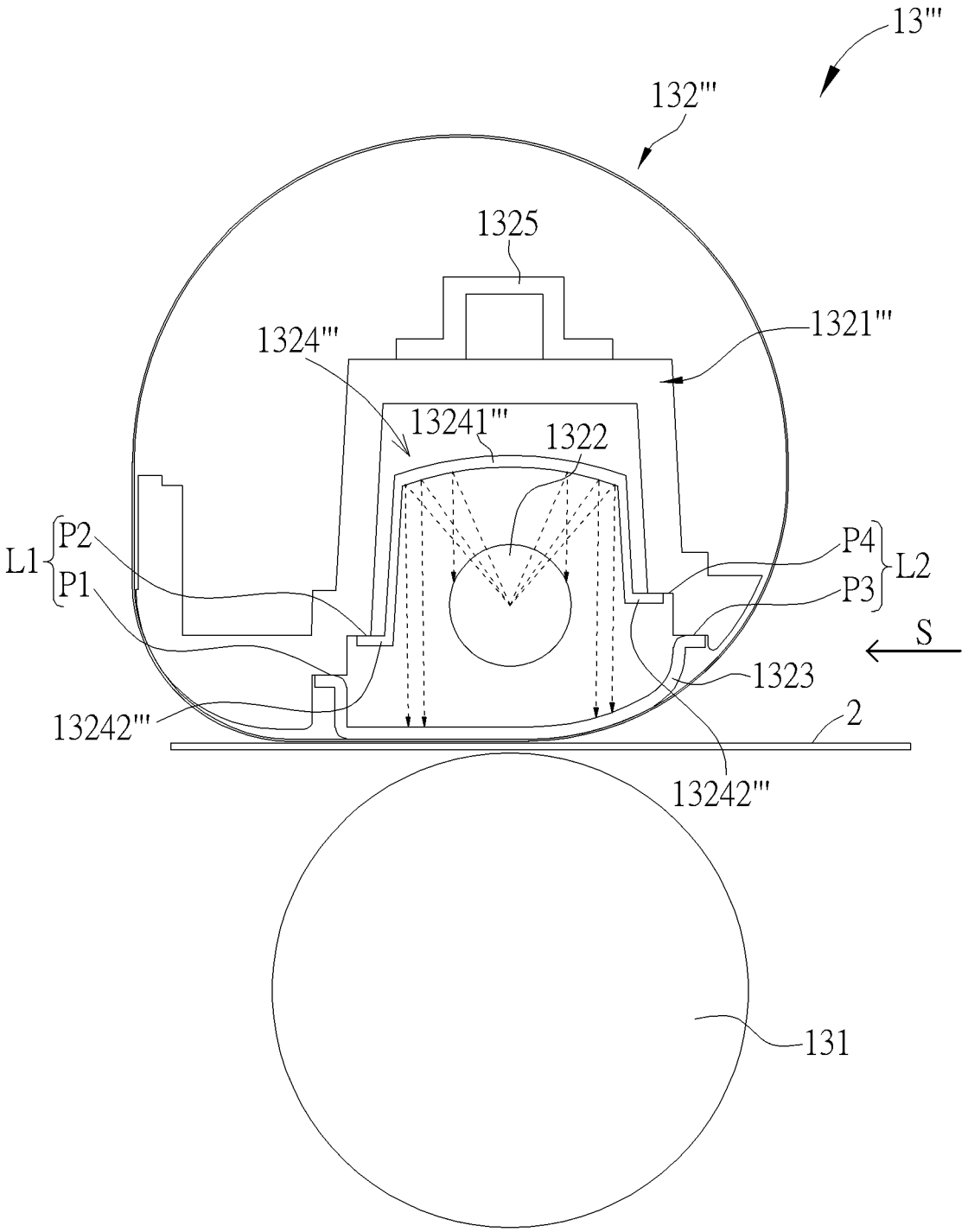
FIG. 5 is a diagram of a fusing device according to a fourth embodiment of the present disclosure.
Figure 6:
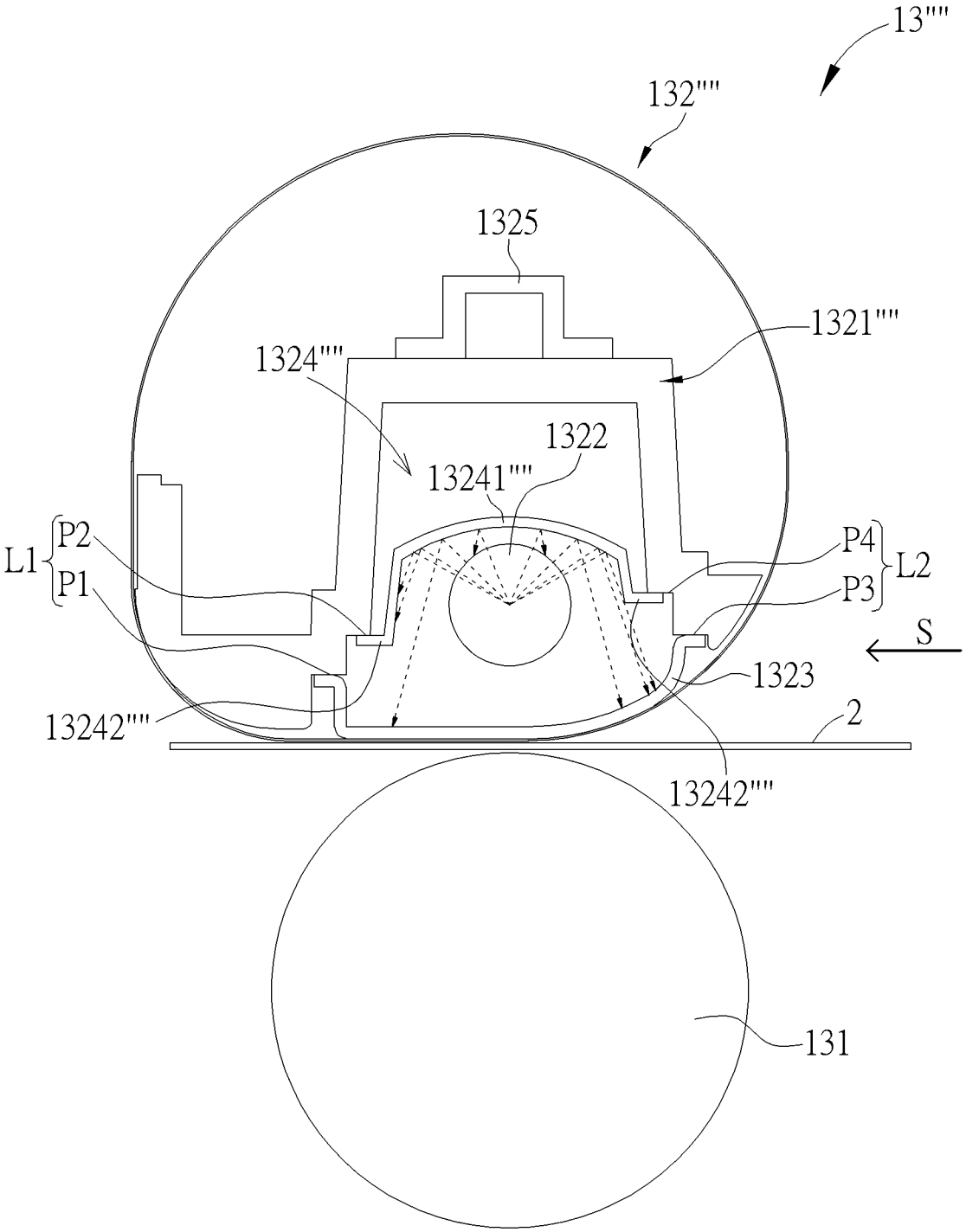
FIG. 6 is a diagram of a fusing device according to a fifth embodiment of the present disclosure.

Besides, please refer to FIG. 5 and FIG. 6. FIG. 5 is a diagram of a fusing device 13''' according to a fourth embodiment of the present disclosure. FIG. 6 is a diagram of a fusing device 13'''' according to a fifth embodiment of the present disclosure. As shown in FIG. 5, a cross section of a reflecting portion 13241''' of a heat reflecting component 1324''' of a fusing unit 132''' of the fusing device 13''' can be formed in a parabolic section substantially. The first step-shaped structure L1 and the second step-shaped structure L2 are formed on a heat insulating component 1321''' of the fusing unit 132'. The two sides of the heat conductive component 1323 are connected to the first disposing platform P1 of the first step-shaped structure L1 and the third disposing platform P3 of the second step-shaped structure L2. Two fixing portions 13242''' of the heat reflecting component 1324''' are connected to the second disposing platform P2 of the first step-shaped structure L1 and the fourth disposing platform P4 of the second step-shaped structure L2. As shown in FIG. 6, a cross section of a reflecting portion 13241'''' of a heat reflecting component 1324'''' of a fusing unit 132'''' of the fusing device 13'''' can be formed in a branch of a hyperbola section substantially. The first step-shaped structure L1 and the second step-shaped structure L2 are formed on a heat insulating component 1321'''' of the fusing unit 132''''. The two sides of the heat conductive component 1323 are connected to the first disposing platform P1 of the first step-shaped structure L1 and the third disposing platform P3 of the second step-shaped structure L2. Two fixing portions 13242'''' of the heat reflecting component 1324'''' are connected to the second disposing platform P2 of the first step-shaped structure L1 and the fourth disposing platform P4 of the second step-shaped structure L2.

In contrast to the prior art, the present disclosure utilizes the reflecting portion formed in the conic section substantially for reflecting the heat generated by the heating component, so that the heat generated by the heating component can be concentrated and reflected to the heat conductive component due to optical characteristic of the conic section. Furthermore, the heat conductive component of the present disclosure is separated from the heat reflecting component and the metal reinforcing component for preventing the heat from being transferred from the heat conductive component to the heat reflecting component or the metal reinforcing component. Therefore, the present disclosure can effectively reduce time of heating the heat conductive component to reach a predetermined temperature, which can save energy and time.

Those skilled in the art will readily observe that numerous modifications and alterations of the device and method may be made while retaining the teachings of the disclosure. Accordingly, the above disclosure should be construed as limited only by the metes and bounds of the appended claims.

What is claimed is:

1. A fusing device for fusing toners onto a printing media, the fusing device comprising:

a driving roller for driving the printing media to move along a moving direction; and a fusing unit comprising:

a heat insulating component, an accommodating space being formed inside the heat insulating component, an opening being formed on a side of the heat insulating component adjacent to the driving roller and communicated with the accommodating space;

a heating component located inside the accommodating space and for generating heat;

a heat conductive component connected to the heat insulating component and covering the opening;

a heat reflecting component located inside the accommodating space and separated from the heat conductive component, the heat reflecting component comprising a reflecting portion, a cross section of the reflecting portion being formed in a conic section substantially, the reflecting portion being located on a side of the heating component away from the heat conductive component and for reflecting the heat generated by the heating component to the heat conductive component; and a fusing component movably surrounding the heat conductive component and the heat insulating component, the heat conductive component transferring the heat to the fusing component, the fusing component contacting with the printing media to fuse the toners onto the printing media when the driving roller drives the printing media to move along the moving direction.

2. The fusing device of claim 1, wherein the cross section of the reflecting portion is formed in a parabola section substantially.

3. The fusing device of claim 2, wherein the heating component is located at a focal point of the reflecting portion.

4. The fusing device of claim 1, wherein the cross section of the reflecting portion is formed in a branch of a hyperbola section substantially.

5. The fusing device of claim 4, wherein the heating component is located at a focal point of the reflecting portion.

6. The fusing device of claim 1, wherein a cross section of the heat insulating component is formed in a U shape substantially, the heat insulating component comprises a first body and a second body connected to each other, the opening is formed on the second body, the heat reflecting component further comprises two fixing portions respectively connected to two sides of the reflecting portion and clamped between the first body and the second body, and the heat conductive component is connected to a side of the second body away from the first body.

7. The fusing device of claim 1, wherein the cross section of the reflecting portion is formed in a partial ellipse section substantially.

8. The fusing device of claim 7, wherein the heating component is located at one of two focal points of the reflecting portion, and the heat conductive component is located at the other of the two focal points of the reflecting portion.

9. The fusing device of claim 7, wherein a cross section of the heat insulating component is formed in a U shape substantially, a first step-shaped structure is formed on a side of the heat insulating component near the opening, the first step-shaped structure comprises a first disposing platform and a second disposing platform, and a side of the heat conductive component and a side of the heat reflecting component are respectively connected to the first disposing platform and the second disposing platform and do not contact with each other.

10. The fusing device of claim 9, wherein a second step-shaped structure is formed on another side of the heat insulating component near the opening, the second step-shaped structure comprises a third disposing platform and a fourth disposing platform, another side of the heat conductive component and another side of the heat reflecting component are respectively connected to the third disposing platform and the fourth disposing platform and do not contact with each other.

11. The fusing device of claim 1, further comprising a metal reinforcing component disposed on a side of the heat insulating component away from the driving roller and separated from the heat conductive component, and the metal reinforcing component reinforces structural strength of the heat insulating component.

12. The fusing device of claim 11, wherein a cross section of the metal reinforcing component is formed in a U shape substantially, and two sides of the metal reinforcing component are fixed on the side of the heat insulating component away from the driving roller.

13. A printing apparatus comprising:

a toner cartridge for storing toners;

a photoconductor drum for transferring the toners from the toner cartridge to a printing media; and a fusing device for fusing toners onto the printing media, the fusing device comprising:

a driving roller for driving the printing media to move along a moving direction; and a fusing unit comprising:

a heat insulating component, an accommodating space being formed inside the heat insulating component, an opening being formed on a side of the heat insulating component adjacent to the driving roller and communicated with the accommodating space;

a heating component located inside the accommodating space and for generating heat;

a heat conductive component connected to the heat insulating component and covering the opening;

a heat reflecting component located inside the accommodating space and separated from the heat conductive component, the heat reflecting component comprising a reflecting portion, a cross section of the reflecting portion being formed in a conic section substantially, the reflecting portion being located on a side of the heating component away from the heat conductive component and for reflecting the heat generated by the heating component to the heat conductive component; and a fusing component movably surrounding the heat conductive component and the heat insulating component, the heat conductive component transferring the heat to the fusing component, the fusing component contacting with the printing media to fuse the toners onto the printing media when the driving roller drives the printing media to move along the moving direction.

14. The printing apparatus of claim 13, wherein the cross section of the reflecting portion is formed in a parabola section substantially.

15. The printing apparatus of claim 14, wherein the heating component is located at a focal point of the reflecting portion.

16. The printing apparatus of claim 13, wherein the cross section of the reflecting portion is formed in a branch of a hyperbola section substantially.

17. The printing apparatus of claim 16, wherein the heating component is located at a focal point of the reflecting portion.

18. The printing apparatus of claim 13, wherein a cross section of the heat insulating component is formed in a U shape substantially, the heat insulating component comprises a first body and a second body connected to each other, the opening is formed on the second body, the heat reflecting component further comprises two fixing portions respectively connected to two sides of the reflecting portion and clamped between the first body and the second body, and the heat conductive component is connected to a side of the second body away from the first body.

19. The printing apparatus of claim 13, wherein the cross section of the reflecting portion is formed in a partial ellipse section substantially.

20. The printing apparatus of claim 19, wherein the heating component is located at one of two focal points of the reflecting portion, and the heat conductive component is located at the other one of the two focal points of the reflecting portion.

21. The printing apparatus of claim 19, wherein a cross section of the heat insulating component is formed in a U shape substantially, a first step-shaped structure is formed on a side of the heat insulating component near the opening, the first step-shaped structure comprises a first disposing platform and a second disposing platform, and a side of the heat conductive component and a side of the heat reflecting component are respectively connected to the first disposing platform and the second disposing platform and do not contact with each other.

22. The printing apparatus of claim 21, wherein a second step-shaped structure is formed on another side of the heat insulating component near the opening, the second step-shaped structure comprises a third disposing platform and a fourth disposing platform, another side of the heat conductive component and another side of the heat reflecting component are respectively connected to the third disposing platform and the fourth disposing platform and do not contact with each other.

23. The printing apparatus of claim 13, wherein the fusing device further comprises a metal reinforcing component disposed on a side of the heat insulating component away from the driving roller and separated from the heat conductive component, and the metal reinforcing component reinforces structural strength of the heat insulating component.

24. The printing apparatus of claim 23, wherein a cross section of the metal reinforcing component is formed in a U shape substantially, and two sides of the metal reinforcing component are fixed on the side of the heat insulating component away from the driving roller.

* * * * *